United States Patent [19]

Umeda et al.

[11] 4,244,450

[45] Jan. 13, 1981

[54] GROUP SUPERVISORY SYSTEM OF ELEVATOR CARS

[75] Inventors: Yasukazu Umeda; Toshiyuki Kamohara; Seiichi Goto; Shintaro Tsuji; Yoshio Miyanishi, all of Inazawa, Japan

[73] Assignee: Mitsubishi Denki Kabushiki Kaisha, Tokyo, Japan

[21] Appl. No.: 57,073

[22] Filed: Jul. 12, 1979

Related U.S. Application Data

[63] Continuation of Ser. No. 844,919, Oct. 25, 1977, abandoned.

[51] Int. Cl.[3] ..... B66B 1/22

[52] U.S. Cl. ..... 187/29 R

[58] Field of Search ..... 187/29

[56] References Cited

U.S. PATENT DOCUMENTS

| | | | |
|---|---|---|---|
| 3,443,668 | 5/1969 | Hall et al. | 187/29 |
| 3,511,342 | 5/1970 | Hall et al. | 187/29 |
| 4,030,571 | 6/1977 | Kaneko et al. | 187/29 |

*Primary Examiner*—Gene Z. Rubinson
*Assistant Examiner*—W. E. Duncanson, Jr.
*Attorney, Agent, or Firm*—Oblon, Fisher, Spivak, McClelland & Maier

[57] ABSTRACT

A group supervisory system of elevator cars is provided which has a waiting time estimating function for estimating the waiting time at each floor and a waiting time evaluating function for giving a predetermined weight to the output of the estimating function.

2 Claims, 10 Drawing Figures

GROUP SUPERVISORY SYSTEM OF ELEVATOR CARS

This is a continuation of application Ser. No. 844,919 filed Oct. 25, 1977, now abandoned.

BACKGROUND OF THE INVENTION

The present invention relates to a group supervisory system of elevator cars.

One of the effective and useful systems to control a bank of elevator cars is the system wherein the choice of a car to serve one of the hall calls with respective functions generated at the respective floors of an office building is decided by taking note of the traffic condition and car travelling condition in the whole building.

This system is called the assigning system which is most commonly employed at present in the group supervisory system of elevator cars and can provide considerably improved service, compared to the conventional elevator control system, i.e. the so called one-round operating system, in which the elevator cars are operated with proper intervals regardless of generation of the hall calls.

Diverse propositions have been made for the assigning system, i.e. the system to select the car to serve the hall call. One such of the systems which are considered to be most effective ones is that the time (waiting time) from generation of a half call to arrival of an elevator car at the floor giving the floor call is directly estimated and the car is assigned in a manner that the sum of the estimated times over all the floors is minimized.

Any of the elevator control systems in which the waiting time is directly estimated and the estimated time is used as an evaluation value, including the just-mentioned system, has a disadvantage; the fretful sensation of human beings for waiting is assumed to be substantially proportional to the physical time of waiting. In other words, anyone feels a longer waiting time than the physical time as the waiting time is longer. From the view point of fact, a curve y showing the evaluation value as a non-linear function of the waiting time is longer (e.g. $v=(t/10)^2$), must be fit for the waiting time sensation of human being beings rather than assuming that the evaluation value v is proportional to the waiting time t(e.g. $v=t/10$) as shown in line x in FIG. 1. However, if the evaluation value for the waiting time longer than a predetermined time is treated as that for a long waiting time and a priority of the car service is given to the floor with such an evaluation value, a great measure of inaccuracy is introduced into the elevator control.

In other words, the conventional elevator control system was such that, as indicated by a line x' in FIG. 2, the chance in the evaluation value v' is the same for each unit waiting time regardless of the length of the waiting time t'. When the sensation of the human being is taken into consideration, however, the change in the evaluation value v' for each unit waiting time must be larger as the waiting time t' is longer, as indicated by a line y'.

SUMMARY OF THE INVENTION

Accordingly, an object of the present invention is to provide a group supervisory system of elevator cars minimizing the fretfulness of passengers in which the car assignment to hall calls is made optimum by properly weighting the waiting time by taking note of the fretful sensation of human beings.

According to one aspect of the present invention, there is provided a group supervisory system of elevators having a waiting time estimating function for estimating the waiting line at each floor and a waiting time evaluation function for giving a predetermined weight to the output of said estimating function.

According to another aspect of the present invention, the waiting time at each floor estimating function estimates the waiting time when a car assigned to a floor call for the respective floor responds; the waiting time evaluation function weights the increment of the output of waiting time estimating function when the hall call is provisionally assigned to the respective car, the increment being as against waiting time estimating function output before the provisional assignment of the newly generated hall call; and the newly generated hall floor call is assigned to the car such that the sum of the outputs of the waiting time estimating function over all the floors is minimum.

These and other objects of this invention will become more apparent upon consideration of the following description of the presently preferred embodiment of the invention and the drawings thereof in which:

DESCRIPTION OF THE PREFERRED EMBODIMENT

An explanation of an embodiment of a group supervisory system of elevators according to the present invention will be given referring to FIGS. 3 through 9.

Figure 1:
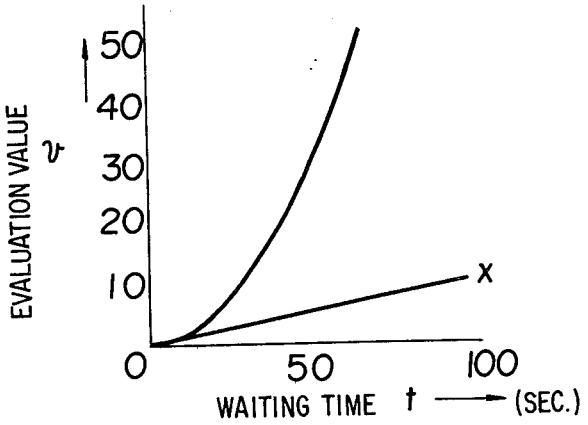
FIGS. 1 and 2 are graphs useful in explaining the objects and features of the present invention.
Figure 2:
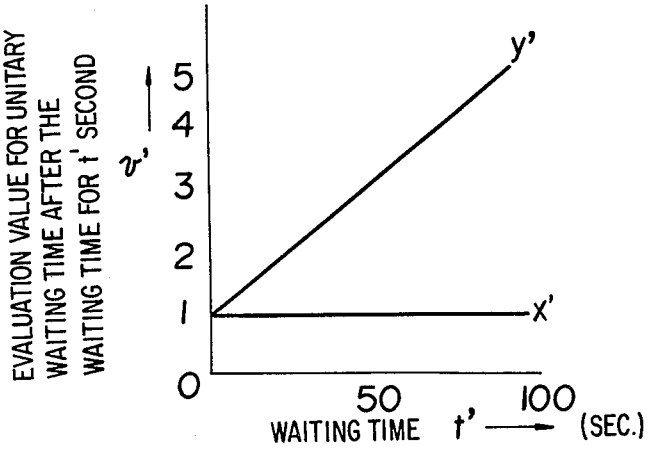
Figure 3:
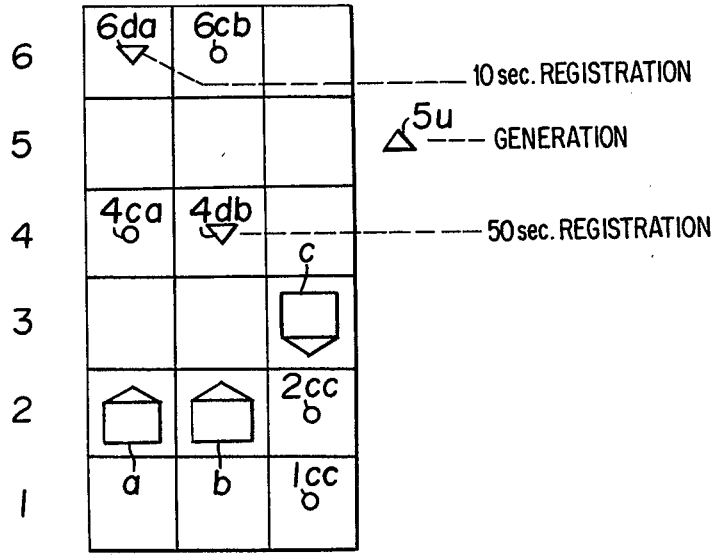
FIG. 3 is a diagram useful in explaining the operation of a group supervisory system of elevators according to the present invention.

Referring now to FIG. 3 illustrating an example of the operation of elevator cars according to the present invention, there are shown three running elevator cars (a), (b) and (c) in a building 6-stories high. In the figure, cars (a) and (b) are going up to the second floor and the car (c) is going down at the third floor. 6*da* represents a down call at the sixth floor which is assigned to the car (a) and elapsed 10 seconds after it is registered. 4*ca* represents car call at the fourth floor which is registered to the car (a). 6*cb* designates a car call at the 6th floor which is registered to the car (b). 4*db* designates a down call at the 4th floor which is assigned to the car (b) and elapsed 50 seconds after registered. 3*cc* and 1*cc* are car calls at the 2nd and first floors, respectively, and 5*u* is representative of an up call at the 5th floor immediately after registered.

Figure 4:
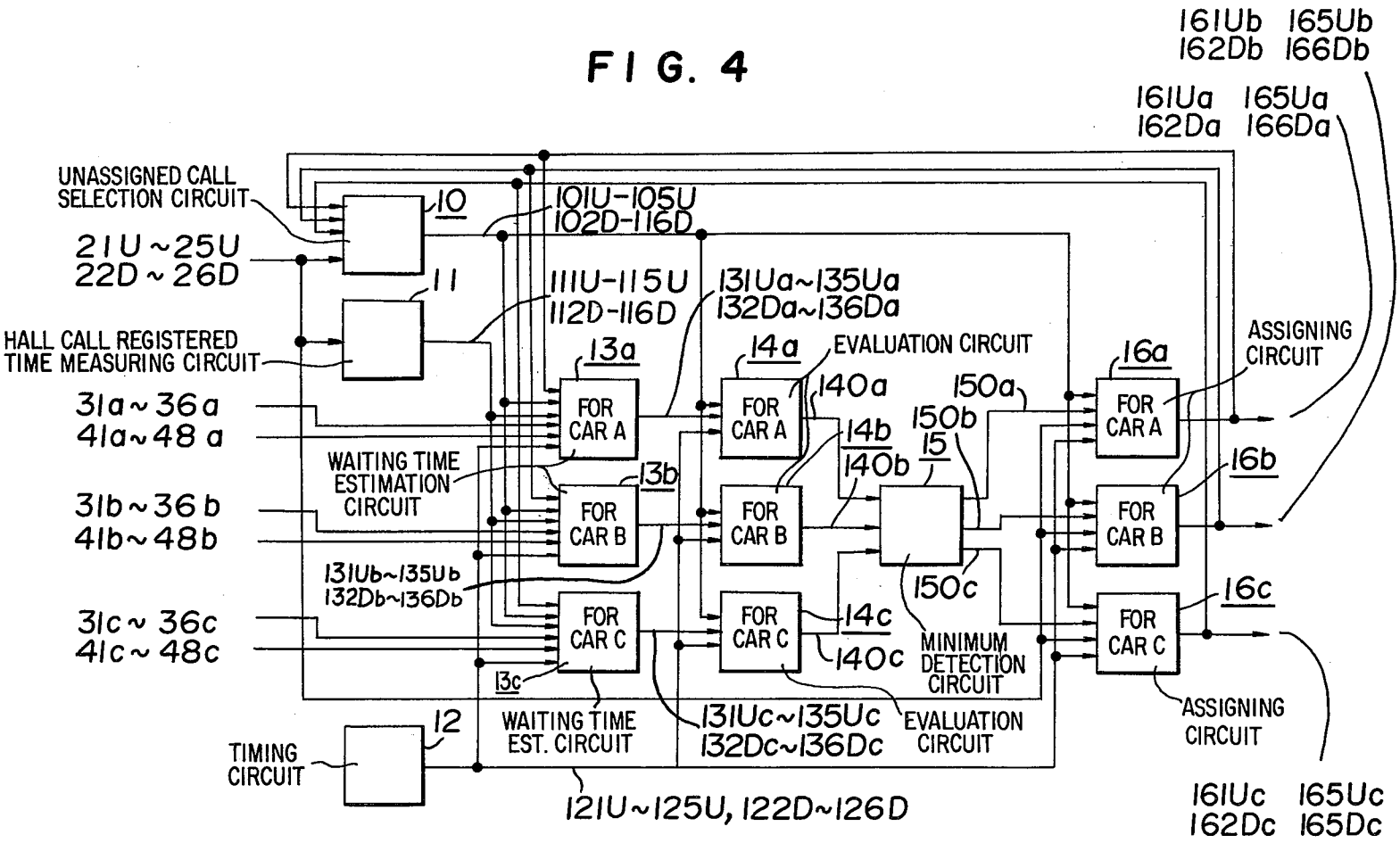
FIG. 4 shows a block diagram of the group supervisory system of elevators according to the present invention.

In FIG. 4 illustrating a block diagram of the system of the present invention, reference symbols have meanings of respective circuits and signals as defined below:

10 . . . Unassigned call selection circuit for selecting unassigned calls.

11 . . . Hall call registered time measuring circuit for counting the time after a hall call is registered.

12 . . . Timing circuit for timing the operations of respective circuits.

13*a* to 13*c* . . . Waiting time estimation circuit for estimating the waiting times of the respective floors to be served by cars. Characters a to c attached designate cars A to C, respectively. The same thing is true in other symbols of this kind.

14*a* to 14*c* . . . Evaluation circuits for calculating the evaluation values when calls are assigned to respective cars.

15 . . . Minimum detection circuits for the minimum value in the outputs of A to C cars evaluation circuits (14*a* to 14*c*).

16*a* to 16*c* . . . Assigning circuits for assigning in actuality hall calls to the respective cars.

21U to 25U . . . Up call signals at the first to 5th floors which are "H" when the up calls at the first to 5th floors are registered.

22D to 26D . . . Down call signals at the 2nd to 6th floors with the same function as of the above.

31*a* to 36*a*, 31*b* to 36*b*, 31*c* to 36*c* . . . Car call signals at the 1st to 6th floors which become "H" in level when they are registered, respectively.

41*a* to 46*a*, 41*b* to 46*b*, 41*c* to 46*c* . . . Car position signals at the 1st to 6th floors which are "H" in level when the respective cars are positioned at the 1st to 6th floors, respectively.

47*a* to 47*c* . . . Up running signals which become "H" when the cars run in the up direction.

48*a* to 48*c* . . . Down running signals with the same functions as of the above.

101U to 105U . . . Unassigned up call signals at the 1st to 5th floors which become "H" in level when the up calls at the 1st to 5th floors are registered but unassigned to any of the cars.

102D to 106D . . . Unassigned down call signals at the 2nd to 6th floors with the same functions as of the above.

111U to 115U . . . Up call registered call time signals at the 1st to 5th floors which represent the times elapsed after the up calls at 1st to 5th floors are registered.

112D to 116D . . . Down call registered signals at the 2nd to 6th floors with the same functions as of the above.

121U to 125U, 122D to 126D . . . Up timing signals at the 1st to 5th floors and down timing signals at the 2nd to 6th floors.

131U*a* to 135U*a*, 131U*b* to 135U*b*, 131U*c* to 135U*c* . . . Up call estimated waiting time signals at the 1st to 5th floors which represent the estimated times from registration of the up calls at the 1st to 5th floors to answer to the calls.

132D*a* to 136D*a*, 132D*b* to 136D*b*, 132D*c* to 136D*c* . . . Down call estimated waiting time signals at the 2nd to 6th floors with the same functions as of the above.

140*a* to 140*c* . . . Evaluation signals representing the evaluation signals when hall calls are assigned to the respective cars.

150*a* to 150*c* . . . Assigning signals which become "H" when the hall calls are assigned to the respective cars.

161U*a* to 165U*a*, 161U*b* to 165U*b*, 161U*c* to 165U*c* . . . Assigning up call signals at the 1st to 5th floors which become "H" when the respective cars are assigned to the up calls at the 1st to 5th floors.

162D*a* to 166D*a*, 162D*b* to 177D*b*, 162D*c* to 166D*c* . . . Assigning down signals at the 2nd to 6th floors with the same functions as of the above.

Figure 5:
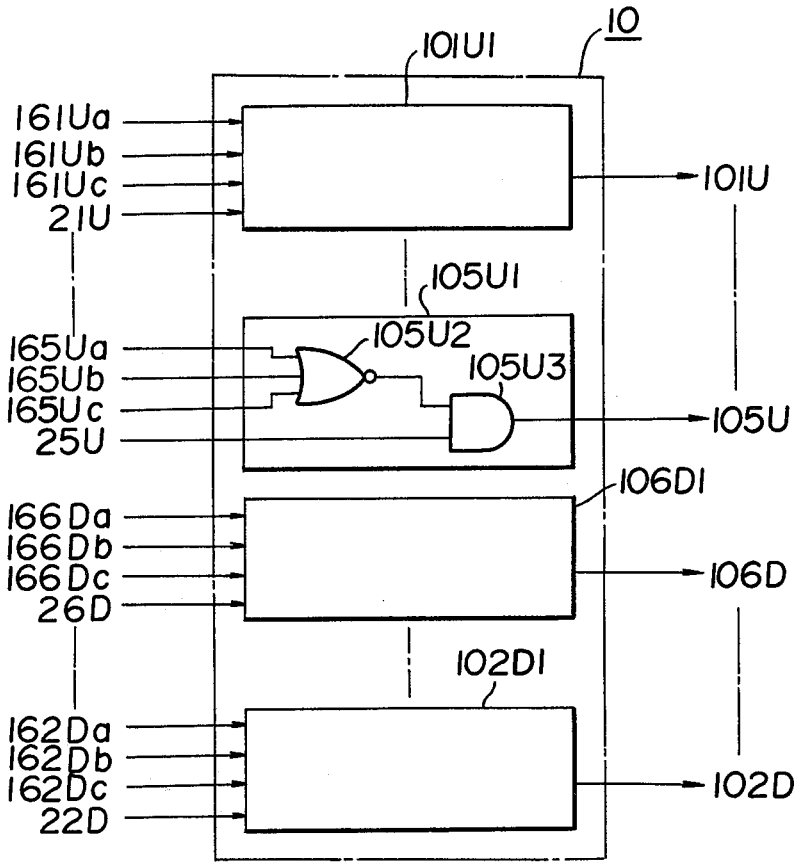
FIG. 5 shows a circuit diagram of an unassigned call selection circuit.

FIG. 5 shows the detail of the unassigned call selection circuit 10. In the figure, 101U1 to 105U1 and 102D1 to 106D1 are the unassigned call selection circuits for going up between the 1st to 5th floors and for going down between the 2nd and 6th floors. Although the detail is illustrated only of the unassigned call selection circuit at the 5th floor in this figure, it is the same as of the circuits at other floors. This is to be repeated in the following drawings.

105U2 designates a NOR gate and 105U3 and AND gate.

Figure 6:
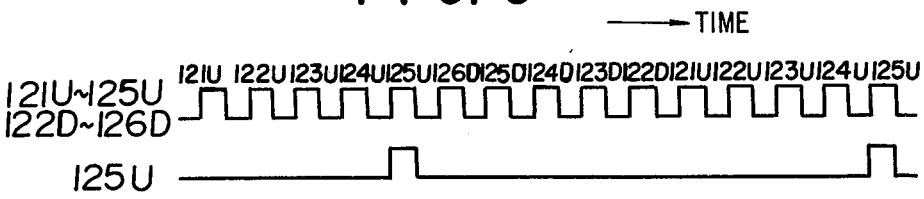
FIG. 6 shows a set of timing diagrams.

FIG. 6 shows the details of the timing signals. As shown in the figure, the respective timing signals pulse with "H" amplitude time-sequentially in the order 121U to 125U and 126D to 122D, and the timing signal 125U, for example, is generated as shown in FIG. 6.

Figure 7:
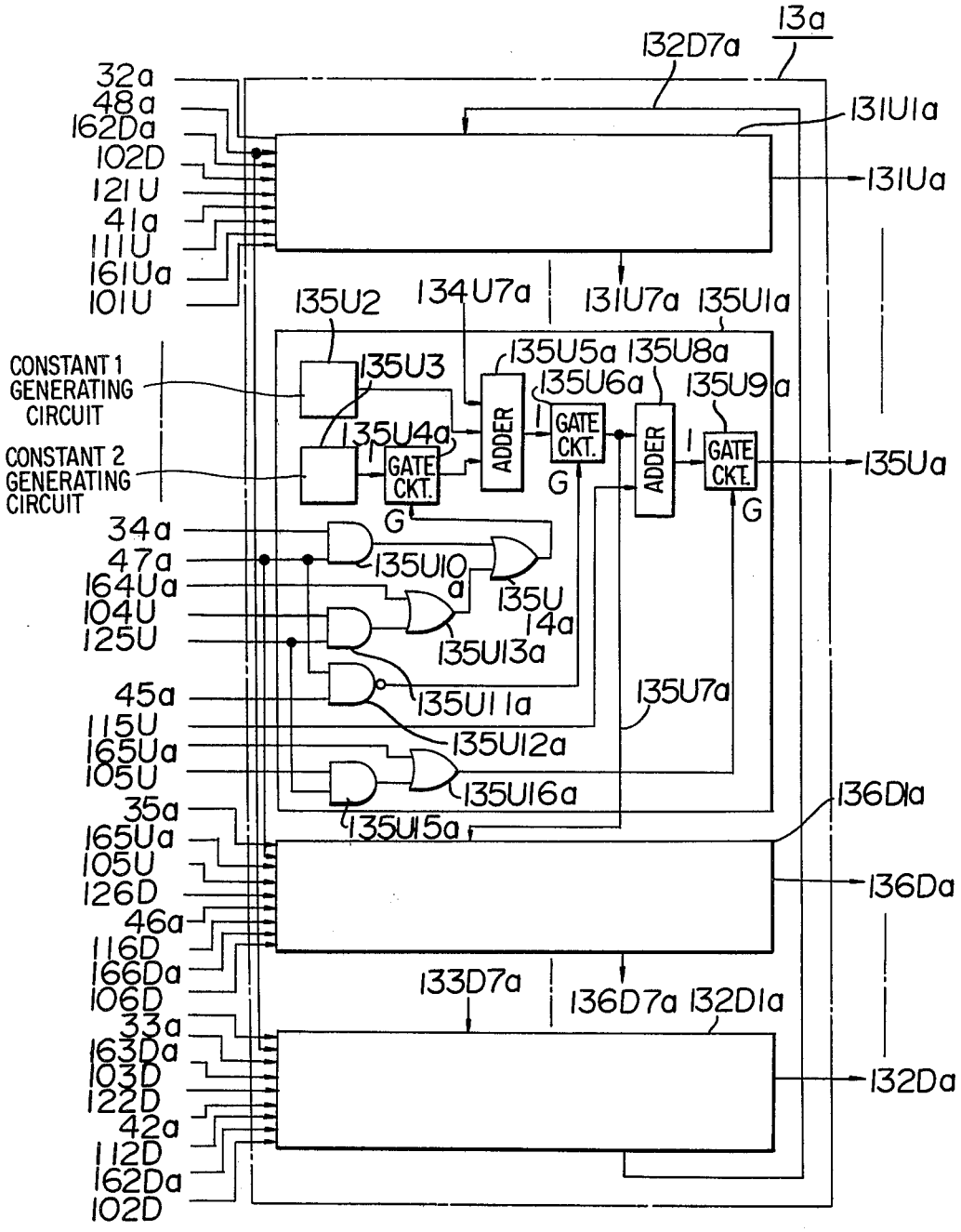
FIG. 7 shows a circuit diagram of a waiting time estimation circuit for a car A.

FIG. 7 shows a detailed circuit diagram of the car A waiting time estimating circuit 13*a*. Here, 131U1*a* to 135U1*a* and 132D1*a* to 136D1*a* respectively show the circuits for going up between the 1st to 5th floors and for going down between the 2nd and 6th floors.

The meaning of other circuits and signals are as follows:

135U2 . . . Constant 1 generating circuit for previously set as a constant 1 the time taken for the car to run in the up direction from the fourth floor to the fifth floor.

135U3 . . . Constant 2 generating circuit for setting as a constant 2 the time when the car stops at the 4th floor in the up direction.

135U4*a* . . . Gate circuit which outputs the signal from
135U6*a* an input line denoted as I as it is when
135U9*a* the signal from an input line denoted as G is "H," and produces 0 when the latter signal is "L."

135U5*a* . . . Adder

135U8*a*

135U7*a* . . . 5th floor up arrival estimated-time signal representing the time taken for the car A to arrive the 5th floor in the up direction. This signal is an output of the gate circuit 135U6*a*.

135U10*a*, 135U11*a*, 135U15*a* . . . AND gates

135U12*a* . . . NAND gate

135U13*a*, 135U14*a*, 135U16*a* . . . OR gates.

Figure 8:
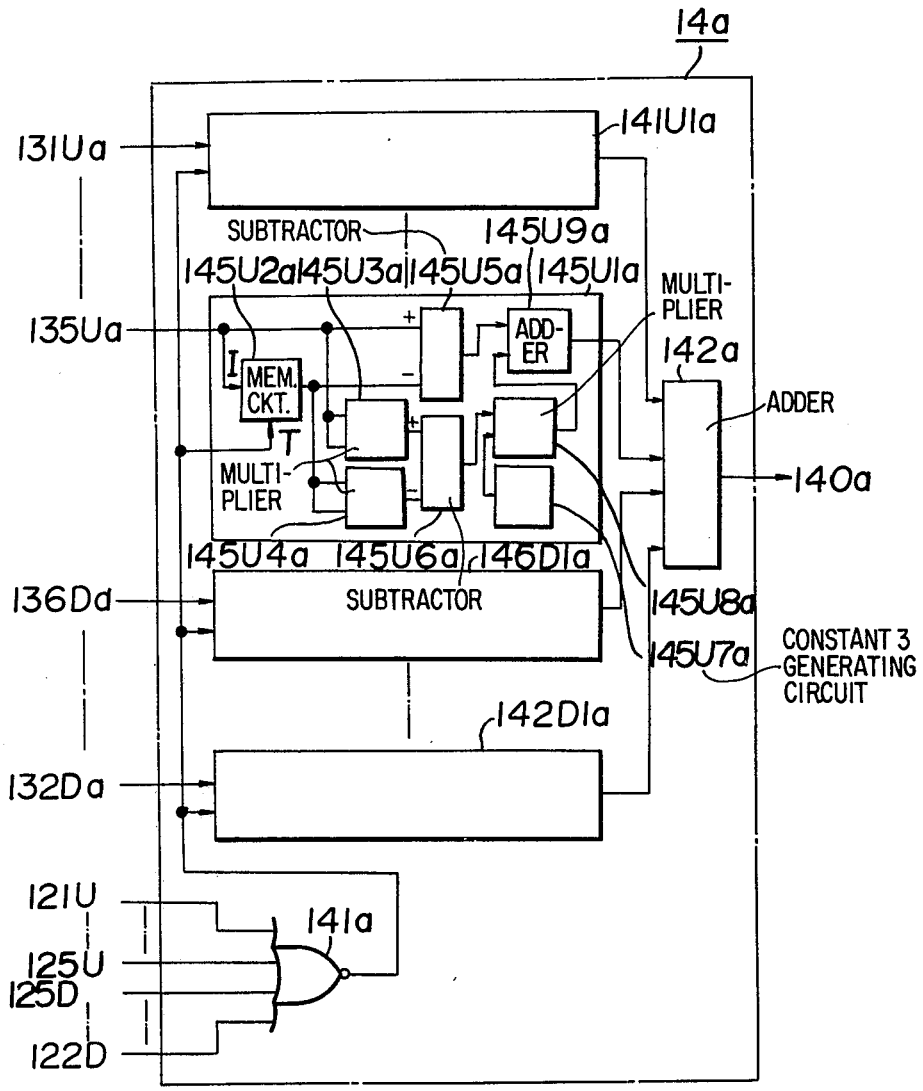
FIG. 8 shows a circuit diagram of an evaluation circuit for the car A.

FIG. 8 shows the detail of the car A evaluation circuit 14*a* and the respective circuits are detailed as follows.

141U1*a* to 145U1*a* . . . Car A evaluation circuits for going up between the 1st and 5th floors.

142D1*a* to 146D1*a* . . . Car A evaluation circuits for going down between the 2nd and 6th floors.

145U2*a* . . . Memory circuit for storing the signal fed from an input line designated by I, when the signal from an input line designated by T is "H," and for outputting the stored signal even when the former signal is "L."

145U3*a*, 145U4*a* and 145U8*a* . . . Multipliers.

145U5*a* and 145U6*a* . . . Subtractors for subtracting the signal from an input line designated by − from the signal from an input line designated by +.

145U7*a* . . . Constant 3 generating circuit for generating a constant C (the meaning of this will be given later).

145U9*a* and 142*a* . . . Adders

141*a* . . . NOR gate

Figure 9:
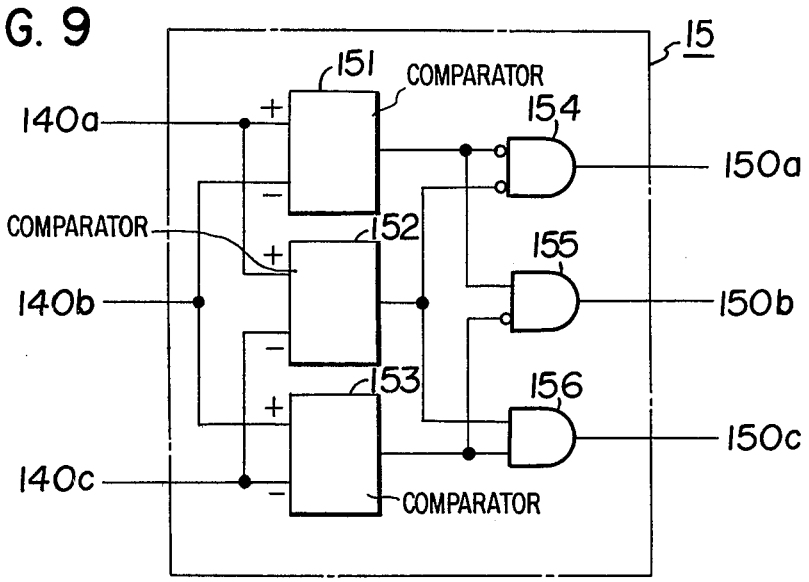
FIG. 9 shows a minimum value detecting circuit.

FIG. 9 shows the detail of the minimum value detection circuit (15) and the respective component circuits are as follows:

151 to 153 . . . Comparators for outputting a signal of "H" when the signal from a line + is larger than the signal from a line − and a signal of "L" when the former is smaller than the latter.

154 to 156 . . . AND gates and circles attached designate the signal level is reversed.

Figure 10:
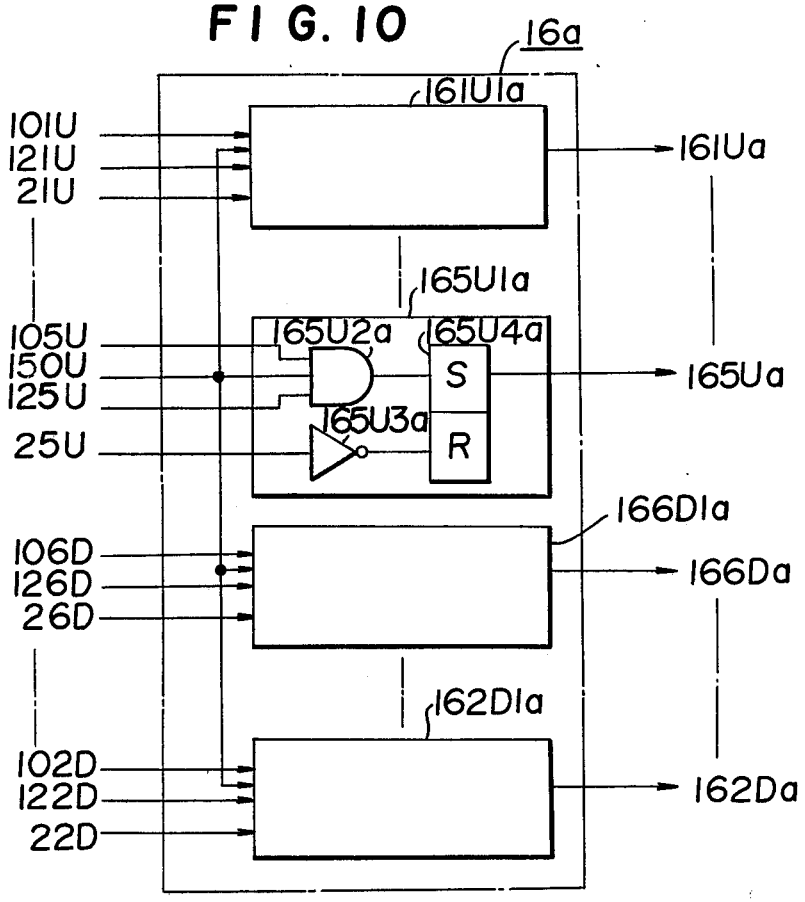
FIG. 10 shows a circuit diagram of a car A assigning circuit.

FIG. 10 shows the detail of the car A assigning circuit 16*a* and the meaning of the respective circuits are as defined below.

161U1*a* to 165U1*a* . . . Car A assigning circuits for going up between the 1st and 5th floors.

162D1*a* to 166D1*a* . . . Car A assigning circuits for going down between the 2nd and 6th floors.

165U2*a* . . . AND gate

165U3*a* . . . NOT gate

165U4*a* . . . Flip-flop circuit which is set to be "H" at the output when the input at the R side is "L" and the input at the S side is "H," and reset to be "L" at the output when the input at the R side is "H."

The explanation to follow is the operation of the embodiment of the group supervisory system of elevators according to the present invention.

A case to be discussed is that the up call at the 5th floor is registered and the up call is assigned to one of the cars.

In FIG. 5, the registration of the up call at the 5th floor causes the 5th floor up call signal 25U to be "H" and there is no car as yet to which the up call has been assigned. Therefore, the 5th floor assigning up call signals for the respective cars (165U*a*, 165U*b*, 165U*c*) are all "L" so that, through the NOR gate 105U2 and the AND gate 105U3, the 5th floor unassigned up call signal 105U becomes "H," indicating that the up call is the one to be assigned.

In FIG. 7, an explanation will be given about the circuit for estimating the time taken for the car A to reach the 5th floor in the up direction. The car A with the car call 4*ca* at the 4th floor is travelling up. Accordingly, the 4th floor car call signal 34*a* and the up travelling signal 47*a* are both "H" which in turn causes the G input of the gate circuit 135U4*a* to be "H," through the AND gate 135U10*a* and the OR gate 135U14*a*. As a result, the output (134U7*a*) of the gate circuit 134U6*a* (not shown), and the outputs of the constant 1 generating circuit 135U2, and the constant 2 generating circuit 135U3 are all inputted to the adder 135U5*a*. The individual outputs of these three circuits are the estimated time taken for the car to reach the 4th floor in the up travel direction, the travelling time of the car from the 4th floor to the 5th floor, and the stopping time at the 4th floor, respectively. As a consequence, so far as the car does not stay at the 5th floor, the total sum of those outputs is the estimated time until the car reaches the 5th floor. At present, the car A does not reach the 5th floor so that the 5th floor car position signal 45*a* is "L," and through the NAND gate 135U12*a*, the G input of the gate circuit 135U6*a* is "H." In this way, the estimated time till the arrival at the 5th floor straightforwardly appears at the output 135U7*a* of the gate circuit 135U6*a*.

The same calculation is applied correspondingly to the other floors and the outputs of them are cyclically coupled to each other. In the cases of the floor at which the car A stays and of the floor coinciding with the travelling direction thereof, the 2nd car positioning signal 42*a* and the up travelling signal 47*a* are both "H" to cause the G input of the gate circuit 132U6*a* to "L" and the output thereof 132U7*a* to be zero. With respect to the symbols of the above which are not shown, see the 5th floor up circuit 135U1*a*. The same shall apply hereinafter. The floor advanced by one from the already assigned floor in the car travelling direction has the 6th floor down call 6d*a* assigned thereto so that the 6th floor assigned down call signal 166D*a* at the 5th down floor becomes "H" to enable the gate circuit 135D4*a* through the OR gates 135D13*a* and 135D14*a* to open thereby to add the stoppage time at the 6th floor and then to produce the arrival time of the car at the 5th down floor.

A 5th floor unassigned up call signal 105U newly generated and the timing signal 126D shown in FIG. 6 are logically summed to provide an input to the G input of the gate circuit 136D4*a*. Therefore, when the timing signal 126D is "H," i.e. only when the 5th up call is assigned to the car A, the stoppage time at the 5th up floor is added to the estimated time of the car arrival at the further advanced floors.

It will be seen that each floor call waiting time is obtained by adding the floor call registered time to the arrival estimated time thus far described. For example, the 6th floor down call waiting time is produced from the gate circuit 136D9*a* as a 6th floor down call estimated time signal 136D*a* after the addition of the 6th floor down arrival estimated time signal 136D7*a* to the 6th floor down call registered time signal 116D. In this case, since the 6th assigned down call signal 166D*a* is "H," the gate circuit 136D9*a* outputs the I input signal without any change. In the case of the floor without the floor call, the output of the gate circuit is zero. The floor call registered time measuring circuit 11 and the timing circuit 12 may be readily realized by using a suitable type timer, a suitable type piezocrystal oscillator or the like, thus omitting the detailed description thereof.

More precisely, assume now that the running time and the stoppage time of each car are 2 seconds and 8 seconds, respectively. In such a case, the arrival estimated times 131U7*a* to 132D7*a* for individual floors related to the car A and the individual floor call estimated waiting times 131U*a* to 132D*a* are tabulated in the following tables. In these tables, the upper table corresponds to the case where the 5th floor up call is not assigned to the car while the lower table to the case where it is assigned to the car.

Arrival estimated times for individual floors and individual floor call estimated waiting times when the 5th floor up call is not assigned

| | Floors | | | | | | | | | |
|---|---|---|---|---|---|---|---|---|---|---|
| Item | 1st floor up | 2nd floor up | 3rd floor up | 4th floor up | 5th floor up | 6th floor down | 5th floor down | 4th floor down | 3rd floor down | 2nd floor down |
| Arrival | | | | | | | | | | |

-continued

| Item | Floors | | | | | | | | | |
|---|---|---|---|---|---|---|---|---|---|---|
| | 1st floor up | 2nd floor up | 3rd floor up | 4th floor up | 5th floor up | 6th floor down | 5th floor down | 4th floor down | 3rd floor down | 2nd floor down |
| estimated time | 34 | 0 | 2 | 4 | 14 | 16 | 26 | 28 | 30 | 32 |
| Floor call estimated waiting time | 0 | 0 | 0 | 0 | 0 | 26 | 0 | 0 | 0 | 0 |

Unit: Second

Arrival estimated times for individual floors and individual floor call estimated waiting times when the 5th floor up call is assigned

| Item | Floors | | | | | | | | | |
|---|---|---|---|---|---|---|---|---|---|---|
| | 1st floor up | 2nd floor up | 3rd floor up | 4th floor up | 5th floor up | 6th floor down | 5th floor down | 4th floor down | 3rd floor down | 2nd floor down |
| Arrival estimated time | 42 | 0 | 2 | 4 | 14 | 24 | 34 | 36 | 38 | 40 |
| Floor call estimated waiting time | 0 | 0 | 0 | 0 | 14 | 34 | 0 | 0 | 0 | 0 |

Unit: Second

In this specification, only this car A was described; however, the same method may be applied for the hall call estimated times calculation of other cars.

The explanation to be made with reference to FIG. 8 is how to apply the estimated waiting times for the respective floor calls for the car assigning evaluation. In the 5th floor up circuit 145U1*a*, the memory circuit 145U2*a* stores the 5th floor up call estimated waiting time signal 135U*a* through a NOR gate 141*a* when all the timing signals 121U to 122D are "L." As described referring to FIG. 7, when the 5th floor up call 25U is provisionally assigned to the car A, the estimated waiting time signal 135U*a* is outputted when the timing signal 125U is "H." Therefore, it is different from the output of the memory circuit 145U2*a*. For ease of explanation, assume now that the estimated waiting time signal 135U*a* at that time is $t_1$ in amplitude, and the output signals of the memory circuit 145U2*a* and the constant 3 generating circuit 145U7*a* are $t_0$ and c, respectively. The output of an adder 145U9*a* after multipliers 145U3*a*, 145U4*a* and 145U8*a* and subtractors 145U5*a* and 145U6*a* is expressed by $(t_1-t_0)+C(t_1^2-t_0^2)$. The multipliers 145U3*a* and 145U4*a* calculate each a square number with two identical signals receiving at the inputs.

Briefly the following is the reason why $(t_1-t_0)+C(t_1^2-t_0^2)$ is used for the output of the adder 145U9*a*, as mentioned above. When one waits a time interval $\Delta t$ for the reason referred to in the opening paragraph the time t thus far waited is weighted and the quantity $$(1+\frac{C}{2}t)\,\Delta t.$$

for example, is used for the evaluation value. Here, $t_1$ and $t_0$ respectively are the estimated waiting times at the floor with the hall call when the car is assigned to a newly generated hall call and when it is not assigned to the one. The evaluation when for the fact that one must additionally wait due to the assignment, must be expressed by $$\int_{t_0}^{t_1}(1+\frac{C}{2}t)\,dt.$$

The integration has the solution $(t_1-t_0)+C(t_1^2-t_0^2)$. This means that the time t is weighted as mentioned above.

Then, the outputs of the adders 141U9*a* to 142D9*a*, i.e. the evaluation value for the waiting time elongation, are added by means of the adder 142*a*, with the result that the evaluation signal 140*a* for the assignment to the car A is obtained.

When C is assumed to be 0.05, the evaluation signals at the respective floors when the 5th up call 5U is assigned to the cars (the outputs of the adders 141U9*a* to 142D9*a* for the car A, for example) and the evaluation signals at all of the floors (140*a* for the car A, for example) are tabulated in the following table.

Evaluation values when the 5th floor up call is assignment to the respective cars

| Assigned cars | Floors | | | | | | | | | | Total |
|---|---|---|---|---|---|---|---|---|---|---|---|
| | 1st floor up | 2nd floor up | 3rd floor up | 4th floor up | 5th floor up | 6th floor down | 5th floor down | 4th floor down | 3rd floor down | 2nd floor down | |
| A | 0 | 0 | 0 | 0 | 23.8 | 32.0 | 0 | 0 | 0 | 0 | 55.8 |
| B | 0 | 0 | 0 | 0 | 7.8 | 0 | 0 | 67.2 | 0 | 0 | 75.0 |
| C | 0 | 0 | 0 | 0 | 67.2 | 0 | 0 | 0 | 0 | 0 | 67.2 |

In FIG. 4, the minimum value detection circuit 15 of which the circuit is detailed in FIG. 9 makes "H" the car A assigned signal 150*a* when the car A evaluation signal 140*a* is minimum. It makes "H" the car B assigned signal 150*b* when the car B evaluation signal 140*b* is minimum. Further, it renders "H" the car C assigned signal 150*c* when the car C evaluation signal 140*c* is minimum. In the just-mentioned example, the evaluation signals 140*a* to 140*c l are* 55.8, 75.0 and 67.2, respectively and accordingly the outputs of the comparators 151 to 153 are "L," "L" and "H," respectively. Therefore, through the AND gates 154 to 156, the car A assigning signal 150*a* becomes "H."

At this time, when the 5th floor unassigned up call signal 105U and the timing signal 125U for the 5th floor up are "H," the flip-flop circuit 165U4*a* is set and the car A 5th floor assigned up call signal 165U4*a* becomes "H," resulting in the completion of the assignment operation of the 5th floor up call. The assigned up call signal 165U*a* is reset when the 5th up call signal 25U is "L." Thus, the assignment is carried out by using the timing signals 121U to 122D with the result that there is presented no problem when improper assigned signals 150*a* to 150*c* are produced during the calculating operation.

Under this traffic condition, the 5th floor up call was assigned to the car A in the system according to the present invention. On the other hand, in a conventional elevator control system, e.g. the system in which the up call is assignment to the car that the sum of all the floor call estimated waiting times are minimum, the estimated waiting times at the respective floors when the 5th floor up calls are assigned to the respective cars, are as follows:

Estimated waiting times at the floors when the 5th floor up call is assigned to the respective floors

| Assigned car | Floors | | | | | | | | | | Total |
|---|---|---|---|---|---|---|---|---|---|---|---|
| | 1st floor up | 2nd floor up | 3rd floor up | 4th floor up | 5th floor up | 6th floor down | 5th floor down | 4th floor down | 3rd floor down | 2nd floor down | |
| A | 0 | 0 | 0 | 0 | 14 | 34 | 0 | 70 | 0 | 0 | 118 |
| B | 0 | 0 | 0 | 0 | 6 | 26 | 0 | 78 | 0 | 0 | 110 |
| C | 0 | 0 | 0 | 0 | 28 | 26 | 0 | 70 | 0 | 0 | 124 |

Unit: Second

In this system, the up call is assigned to the car B and a 78 seconds long time waiting call is generated. Therefore, when the waiting times at all the floors is taken into consideration, the waiting time must be weighted not by merely the physical time but by the human being's sensation to the time. Such the weighting also is needed in order to avoid the packing of the car with passengers. The detailed description thereof will be omitted here.

In this embodiment, the weight function used was $(t_1-t_0)+C(t_1^2-t_0^2)$ ($t_1$: estimated waiting time after the assignment, $t_0$: estimated waiting time before the assignment, C: constant). Additionally, the weight function depending on the kind of the floor, the traffic condition, time, switches used may be employed in place of the above.

In this example, the estimated waiting time was calculated rather simply by the travelling time and the stoppage time of each car. If generation of new calls (floor calls and car calls) is further taken into account, the estimated waiting time obtained is more elaborate.

The concept of the present invention may be applied not only for the car assignment method of this example, but also to the assigned car changing method and the method to predict the service car.

As described above, in the elevator control system of this invention, the waiting time is estimated by taking account of the human being's sensation to the waiting time and the suitable car is assigned them. As a consequence, the group supervisory system of elevator cars may be provided minimizing complaints of elevator passengers.

What is claimed is:

1. A group supervisory system of elevator cars which comprises:

waiting time estimating function means for estimating the waiting time at each floor; and waiting time evaluation function means for giving a predetermined weight to the estimated waiting time output of said estimating function means, said predetermined weight being a variable computed as a function of the estimated waiting time and utilized by the supervisory system as an additional factor in assigning a car to a call.

2. A group supervisory system of elevator cars according to claim 1, wherein:

the waiting time estimating function means estimates the waiting time at each floor when a car assigned to a floor call for the respective floor responds;

the waiting time evaluation function means weights an increment in waiting time at the output of the waiting time estimating function means when a newly generated hall call is provisionally assigned to the respective car, the increment being as against the waiting time estimating function means output before the provisional assignment of the newly generated hall call; and including means for assigning the newly generated hall call to a car such that the sum of the outputs of the waiting time evaluation function for all the cars over all the floors is minimum.

* * * * *